US006568987B1

(12) United States Patent
So

(10) Patent No.: US 6,568,987 B1
(45) Date of Patent: May 27, 2003

(54) BRAKE ASSEMBLY FOR A TOY VEHICLE

(75) Inventor: Moon-Lam So, Kowloon (HK)

(73) Assignee: May Cheong Toy Products Factory Limited, Kowloon (HK)

( * ) Notice: Subject to any disclaimer, the term of this patent is extended or adjusted under 35 U.S.C. 154(b) by 0 days.

(21) Appl. No.: 10/068,999

(22) Filed: Feb. 7, 2002

(51) Int. Cl.[7] ..... A63H 17/00
(52) U.S. Cl. ..... 446/465; 188/68; 446/437
(58) Field of Search ..... 446/465, 437, 446/466, 448, 460, 468, 469; 188/82.1, 82.7, 82.77, 68

(56) References Cited

U.S. PATENT DOCUMENTS 4,485,586 A * 12/1984 Halford et al. ..... 446/448
4,533,336 A * 8/1985 Dixon et al. ..... 446/465
4,702,720 A * 10/1987 Konta et al. ..... 446/448
6,036,575 A * 3/2000 Rehkemper et al. ..... 446/466
6,250,433 B1 * 6/2001 Sealine et al. ..... 188/69

* cited by examiner

*Primary Examiner*—Jacob K. Ackun
*Assistant Examiner*—Jamila Williams
(74) *Attorney, Agent, or Firm*—Alix, Yale & Ristas, LLP

(57) ABSTRACT

A brake assembly for a toy vehicle includes first and second wheel assemblies mounted on a axle, a cam which is rotatable with the first wheel assembly, and a brake member which is activatable by the cam to engage the second wheel assembly. An orthogonal gear assembly, including first and second gear members, drives the cam. A shaft member is disposed orthogonal to the axle and bears the cam and second gear member. The first gear member is mounted an the axle. The shaft is pivotally mounted and movable between a first position in which the first and second gear members are engaged and a second position in which the first and second gear members are disengaged.

15 Claims, 4 Drawing Sheets

BRAKE ASSEMBLY FOR A TOY VEHICLE

BACKGROUND OF THE INVENTION

1. Field of the Invention

The present invention relates to a toy vehicles, and more particularly to self propelled battery operated toy vehicles. More specifically the invention relates to a brake assembly for such toy vehicles.

2. Background Information

Self propelled battery powered toy vehicles are well known. Typically, however, they are only adapted to a single type of operation, for example to propel themselves across a surface in a straight line. Children have a short attention span and soon loose interest in these toys. There have been trends to try and imitate real vehicles or to create more imaginative toy vehicles that stimulate greater interest.

SUMMARY OF THE INVENTION

It is an object of the present invention to provide a brake assembly for a toy vehicle that produces interesting action and can retain the interest of a user. It is a further object of the invention to at least ameliorate the above-mentioned problems or to provide the public with a useful alternative.

A brake assembly for a toy vehicle includes first and second wheel assemblies, a cam rotatable with the first wheel assembly, and a brake member activatable by the cam to engage the second wheel assembly. The first wheel assembly is fixedly disposed at a first end of an axle member and the second wheel assembly is rotatably disposed at a second end of the axle member, the cam is driven from the axle member by a gear assembly.

Preferably, the gear assembly includes first and second orthogonal gear members. A shaft member is disposed orthogonal to the axle, the cam and second gear member are fixedly mounted on the shaft and the first gear member is fixedly mounted on the axle.

More preferably, the shaft is pivotally mounted and movable between a first position in which the first and second gear members are engaged and a second position in which the first and second gear members are disengaged.

Preferably, the brake member is a biased pin in sliding contact with the cam at its first end and adapted to engage the second wheel assembly at its second end. The second wheel assembly may include a plurality of apertures for receiving the second end of the pin.

A toy vehicle includes a body member including a chassis. A first control arm assembly is pivotally mounted to the body at its first end and has at least one suspension strut at its second end. A drive axle is rotatably mounted with the first control arm assembly and bears first and second wheel assemblies. A drive member is in communication with the drive axle for propelling the toy vehicle across a surface. There is a second control arm assembly pivotally mounted to the body at a first end and having at least one suspension member at its second end. A brake axle is rotatably mounted with the second control arm assembly and bears third and forth wheel assemblies. They toy vehicle also includes a brake assembly as hereinbefore defined. Preferably, the brake axle is the front axle of the toy vehicle.

Further aspects of the invention will become apparent from the following description, which is given by way of example only.

BRIEF DESCRIPTION OF THE DRAWINGS

Embodiments of the invention will now be describe with reference to the accompanying drawings in which.

DESCRIPTION OF THE PREFERRED EMBODIMENTS

Figure 1:
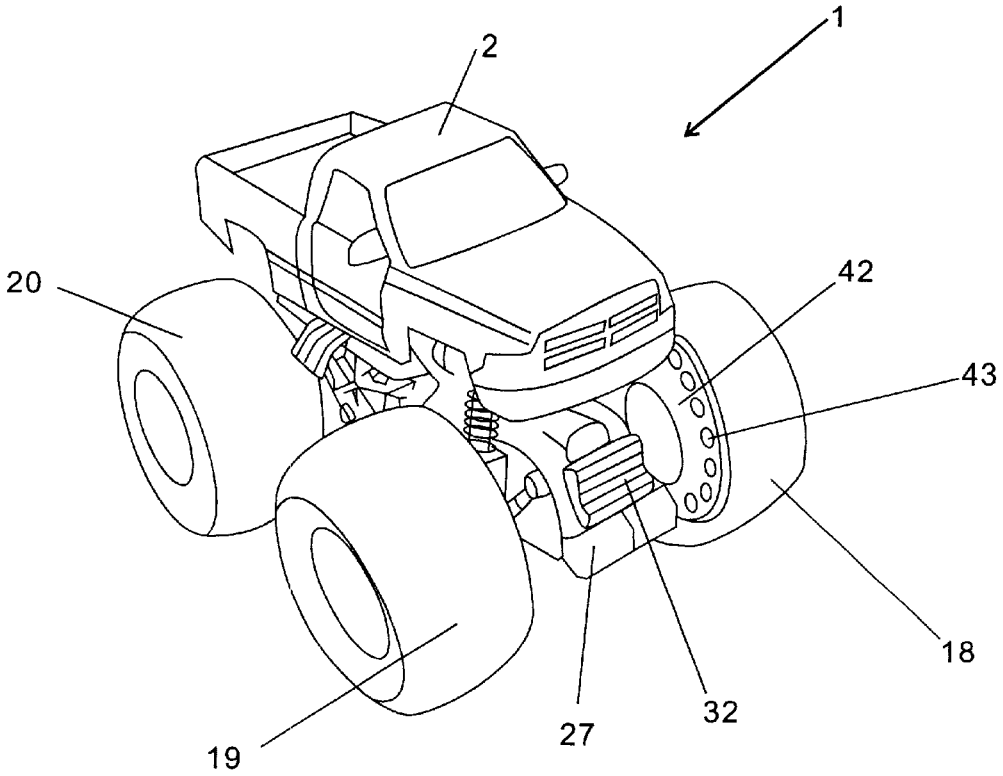
FIG. 1 illustrates a perspective view of a toy vehicle.
Figure 2:
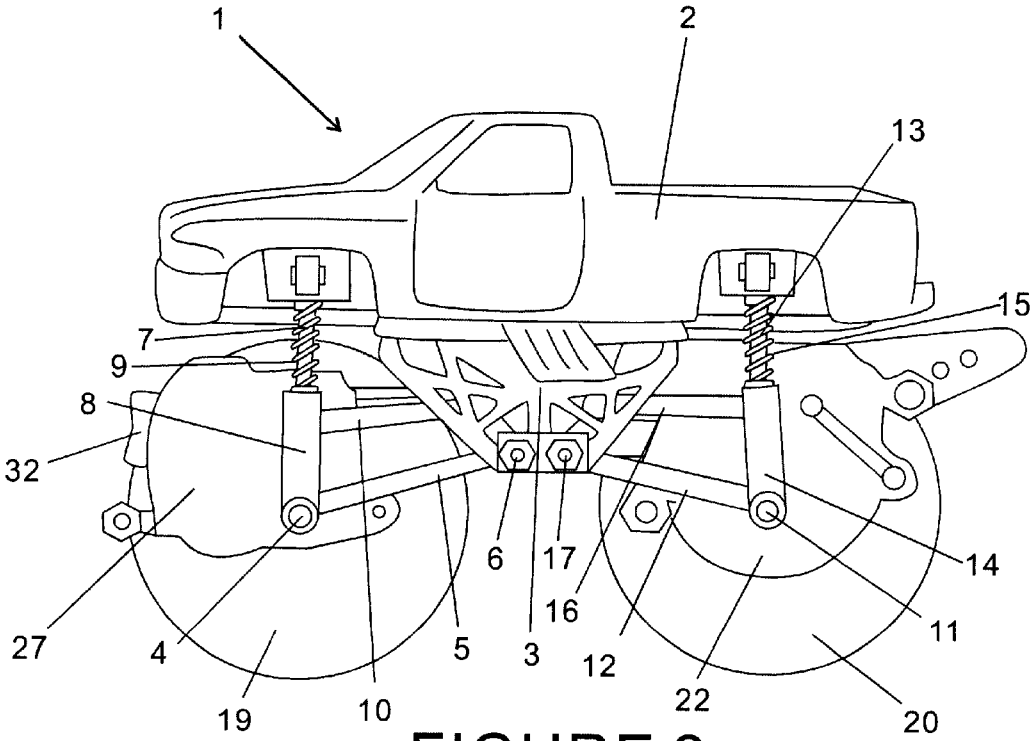
FIG. 2 illustrates a side elevation view of the toy vehicle.

Referring to FIGS. 1 and 2 there shown is a toy vehicle 1 comprising a body member 2 supported on a chassis 3. A front (brake) axle 4 is supported by a lower front control arm 5 that is pivotally mounted to the chassis 3 at its first end by a pin 6. Front axle 4 is connected to body 2 at its second end by a suspension strut comprising upper strut member 7 which is slidably engage within a lower strut member 8. A coil spring 9 is dispose about upper strut member 7. An upper front control arm 10 links lower strut member 8 to chassis 3 to provide additional tensional support.

In like manner a rear (drive) axle 11 is supported on a lower rear control arm 12 pivotally attached to the chassis 3 at its first end by a pin 17. A suspension strut, comprising upper strut member 13, lower strut member 14 and coil spring 15, connects the second end of axle 11 to body 2. An upper rear control arm 16 provides tensional support.

On either end of front axle 4 are dispose two front wheel assemblies 18, 19 and on either end of rear axle 11 are dispose two rear wheel assemblies 20, 21 (not shown). The two rear wheels are fixedly engaged with the rear axle. However, only one front wheel 19 (the right hand side wheel) is fixedly engaged with the front axle 4. The opposite front wheel 18 (the left hand side wheel) is rotatably disposed on the front axle and is free to rotate independently of the axle.

Figure 3:
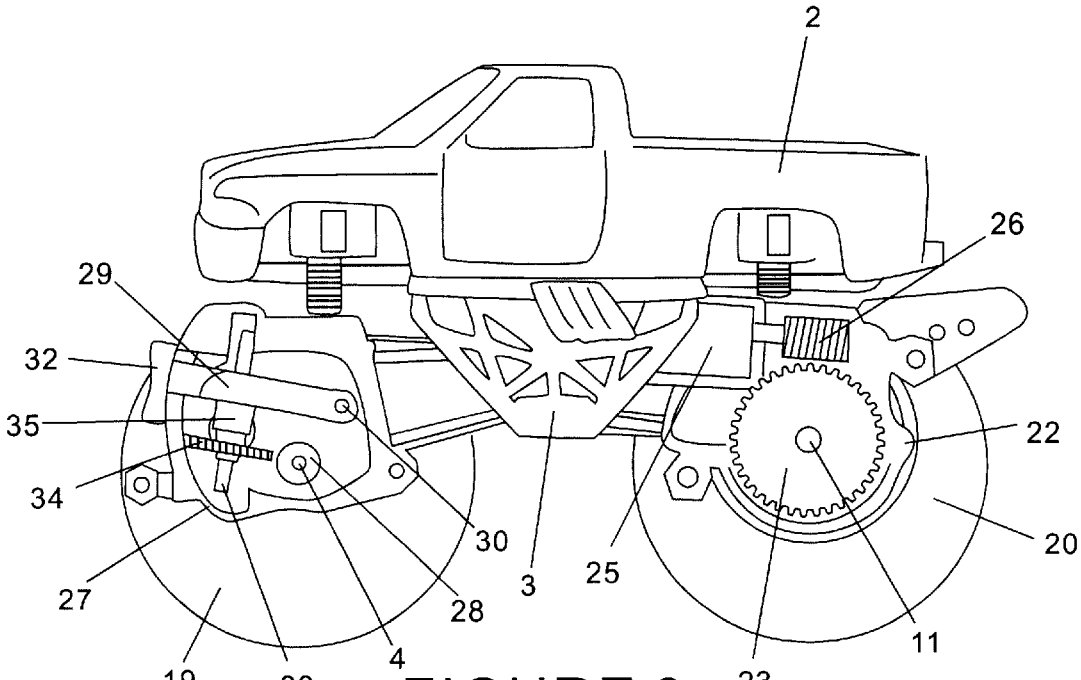
FIG. 3 illustrates a first side elevation view of a wheel brake assembly.

Referring to FIG. 3, dispose between the two rear wheel assemblies 20, 21 is a drive housing 22. Rear axle 11 passes through housing 22 and bears a toothed gear 23. Mounted within housing 22 is a motor 25 bearing a threaded cylindrical worm gear 26 on its output shaft. Worm gear 26 and toothed gear 23 engage to facilitate propulsion of the toy vehicle by motor 25. Batteries (not shown) are provided in the body 2, along with an on/off switch (not shown) to facilitate operation of the motor.

Dispose between front wheels 18 and 19 is a break assembly housing 27. Front axle 4 passes through brake housing 27. Within housing 27 front axle 4 bears a threaded cylindrical worm gear 28. A switch arm 29 is pivotally mounted within the housing at one of its ends by a pin 30. The arm extends throughout an elongate opening 44 in the front of housing 27. External the housing 27 switch arm 29 bears a switch handle 32.

Figure 4:
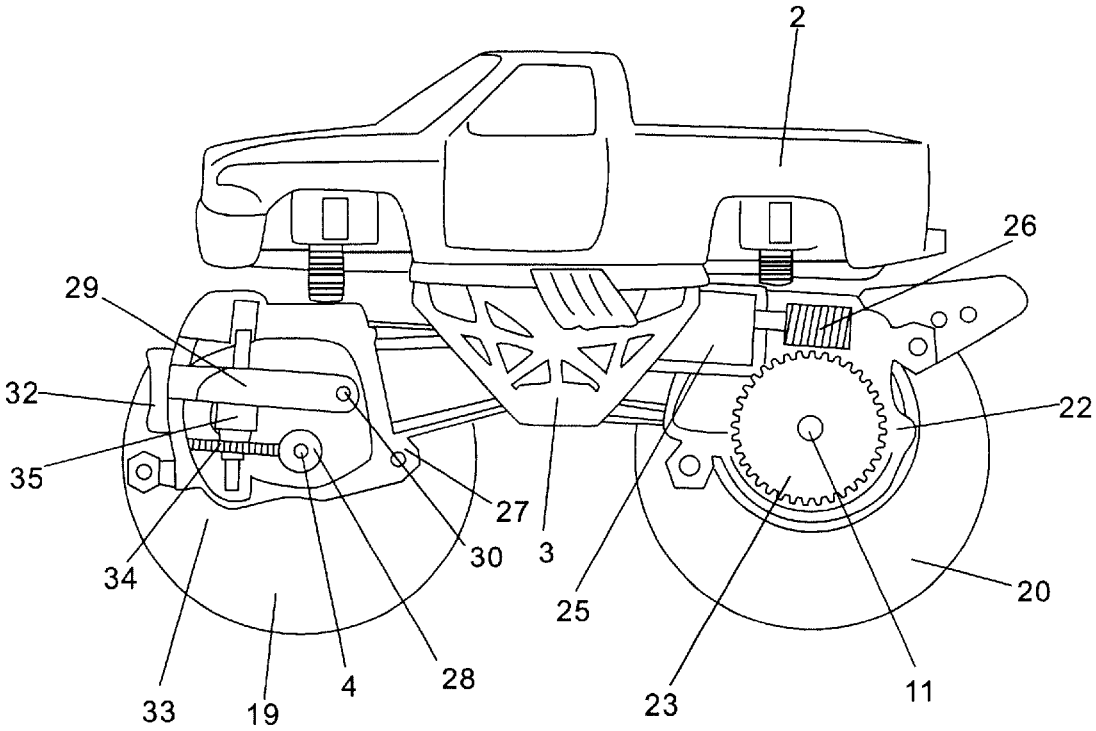
FIG. 4 illustrates a second side elevation view of the wheel brake assembly.

Mounted on switch arm 29, intermediate its ends, is a shaft 30. Shaft 30 is orthogonal to front axle 4. A toothed gear 34 is fixedly mounted on shaft 33. Switch arm 29 can be moved, via switch handle 32, from a first position as shown in FIG. 3 wherein tooth gear 34 is disengaged from worm gear 28 to a second position as shown in FIG. 4 wherein the tooth gear 34 is engaged with worm gear 28.

Figure 5:
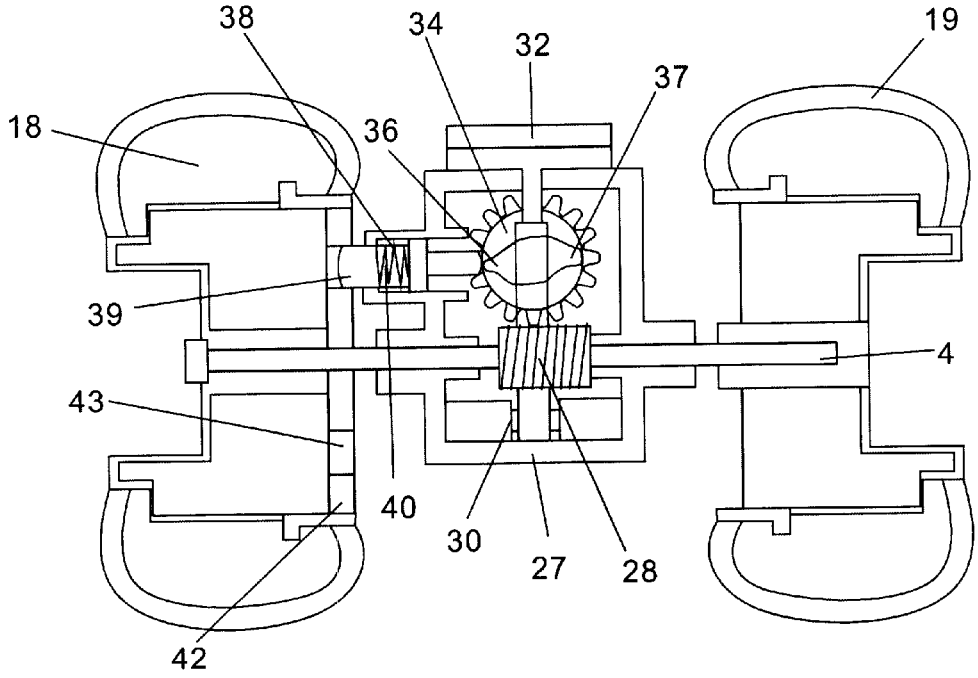
FIG. 5 illustrates a first top view of the wheel brake assembly.
Figure 6:
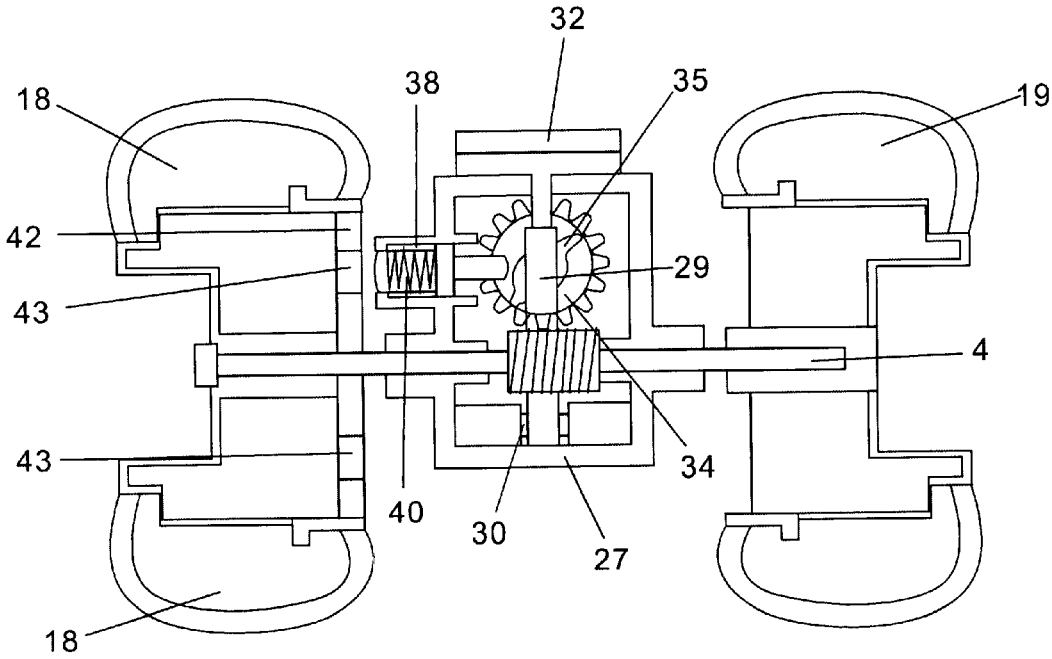
FIG. 6 illustrates a second top view of the wheel brake assembly.
Figure 7:
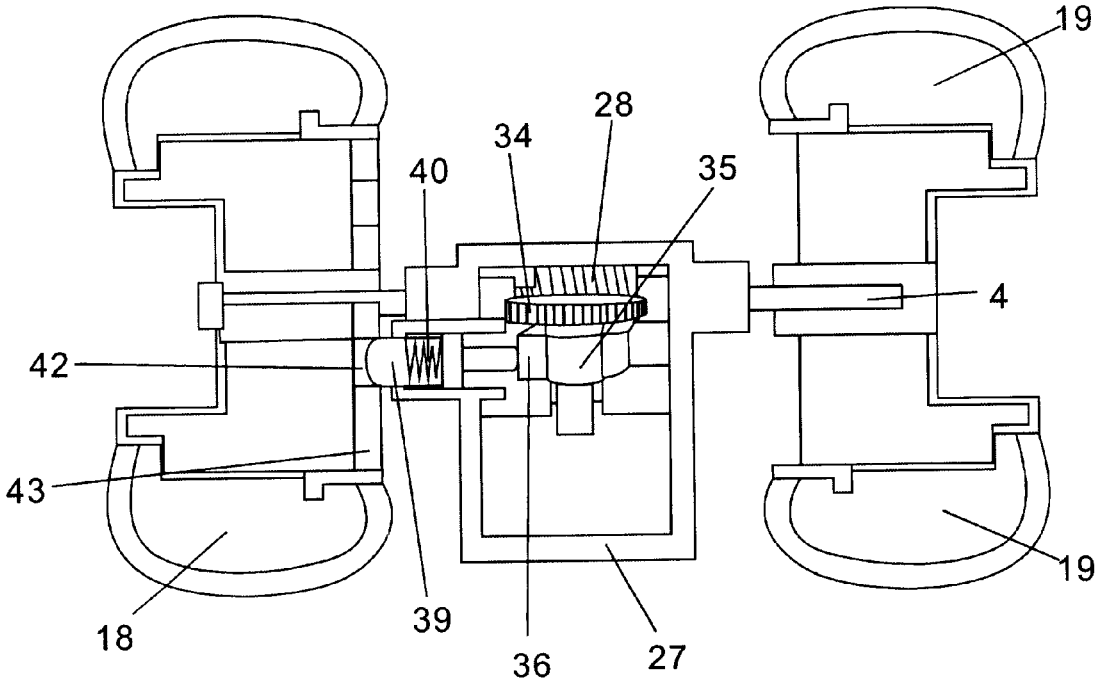
FIG. 7 illustrates a front view of the wheel brake assembly.

Referring to FIGS. 5 to 7, dispose in juxtaposition the tooth gear 34 on shaft 33 is a cam 35 having two diametrically opposed lobes 36, 37. Housing 27 has a cylindrical tube 38 located in its sidewall adjacent left-hand front tire 18. Slidably located within the bore of tube 38 is an elongate pin 39 which is biased by a spring 40 so as to be in a retracted position as shown in FIG. 6.

The first end of the pin 39 is adapted to slidably engage the cam 35. When a lobe 36, 37 of cam 35 is under the first end of pin 39 the pin is in an extended position as shown in FIGS. 5 and 6.

The inner opening of the left-hand side wheel assembly 18 has a disk 42 dispose therein. Around the periphery of the disk 42 are a plurality of apertures 43 adapted to receive the second end of pin 39 when it is in the extended position.

In use, the vehicle break is activated by moving handle member 32 from the first (upper) position to the second (lower) position to engage the brake gears 28, 34. When the vehicle is pushed or propelled, by the rear wheels, rotation of the right front wheel assembly 19 rotates the cam 35 via axle 4 and gears 28, 34. Every one half rotation of cam 35 one of the lobes 36, 37 extends pin 39 out of housing 38. When pin 39 is orientated with an aperture 43 in disk 42 it will locate therein locking the left front wheel assembly 18. Right front wheel assembly 19 and axle 4 are still free to rotate. As the cam 35 moves further round its travel pin 39 is retracted by the force of is bias spring and thus left front wheel 18 is again free to rotate.

As the toy vehicle moves long a surface left front wheel 18 will periodically brake for short period by operation of the brake assembly. This creates a jerky type motion that bounces the toy vehicle's suspension thus crating an interesting effect. On some types of surface the toy vehicle may also be cause to turn by braking of one front wheel assembly.

Where in the foregoing description reference has been made to integers or elements have known equivalents then such are included as if individually set forth herein.

Embodiments of the invention have been described, however it is understood that variations, improvement or modifications can take place without departure from the spirit of the invention or scope of the appended claims.

I claim:

1. A brake assembly for a toy vehicle including:

first and second wheel assemblies, a cam rotatable with the first wheel assembly, and a brake member activatable by the cam to engage the second wheel assembly.

2. A brake assembly as claimed in claim 1 wherein the first wheel assembly is fixedly disposed at a first end of an axle member and the second wheel assembly is rotatably disposed at a second end of the axle member, the cam being driven from said axle member by a gear assembly.

3. A brake assembly as claimed in claim 2 wherein the gear assembly includes first and second orthogonal gear members.

4. A brake assembly as claimed in claim 3 including a shaft member disposed orthogonal to the axle, the cam and second gear member being fixedly mounted on said shaft and the first gear member being fixedly mounted on the axle.

5. A brake assembly as claimed in claim 4 wherein the shaft is pivotally mounted and movable between a first position in which the first and second gear members are engaged and a second position in which the first and second gear members are disengaged.

6. A brake assembly as claimed in claim 1 wherein the brake member is a biased pin in sliding contact with the cam at its first end and adapted to engage the second wheel assembly at its second end.

7. A brake assembly as claimed in claim 6 wherein the second wheel assembly includes a plurality of apertures for receiving the second end of the pin.

8. A toy vehicle including:

a body member including a chassis, a first control arm assembly pivotally mounted to the body at a first end and having at least one suspension strut at its second end, a drive axle rotatably mounted with the first control arm assembly, and bearing first and second wheel assemblies, a drive member in communication with the drive axle for propelling the toy vehicle across a surface, a second control arm assembly pivotally mounted to the body at a first end and having at least one suspension member at its second end, a brake axle rotatably mounted with the second control arm assembly, and bearing third and forth wheel assemblies, and a brake assembly including a cam member driven from the third wheel assembly, and a brake member activatable by the cam member to engage the forth wheel assembly.

9. A brake assembly as claimed in claim 8 wherein the third wheel assembly is fixedly disposed at a first end of the brake axle and the forth wheel assemble is rotatably disposed at the second end of the brake axle, the cam being driven from the brake axle by a gear assembly.

10. A toy vehicle as claimed in claim 9 wherein the gear assembly includes first and second orthogonal gear members.

11. A toy vehicle as claimed in claim 10 including a shaft member disposed orthogonal to the brake axle, the cam and second gear member being fixedly mounted on said shaft and the first gear member being mounted on the brake axle.

12. A toy vehicle as claimed in claim 11 wherein the shaft is pivotally mounted and movable between a first position in which the first and second gear members are engaged and a second position in which the first and second gear members are disengaged.

13. A toy vehicle as claimed in claim 8 wherein the brake member is a biased pin in sliding contact with the cam at its first end and adapted to engage the forth wheel assembly at its second end.

14. A toy vehicle as claimed in claim 13 wherein the second wheel assembly includes a plurality of apertures for receiving the second end of the pin.

15. A toy vehicle as claimed in claim 1 wherein the brake axle is the front axle of the toy vehicle.

* * * * *